US011732856B2

(12) United States Patent
Fedosik et al.

(10) Patent No.: US 11,732,856 B2
(45) Date of Patent: Aug. 22, 2023

(54) LIGHTING DEVICE FOR VEHICLES HAVING TWO LIGHT SOURCES AND A FREE FORM LIGHT DIRECTING MEMBER FOR EMITTING TWO LIGHT DISTRIBUTIONS

(71) Applicant: HELLA GmbH & Co. KGaA, Lippstadt (DE)

(72) Inventors: Dmitry Fedosik, Lippstadt (DE); Franz-Josef Kalze, Harsewinkel (DE); Dirk Schwemin, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/877,245

(22) Filed: Jul. 29, 2022

(65) Prior Publication Data

US 2022/0364698 A1 Nov. 17, 2022

Related U.S. Application Data

(63) Continuation of application No. PCT/EP2021/051271, filed on Jan. 21, 2021.

(30) Foreign Application Priority Data

Jan. 30, 2020 (DE) ..... 10 2020 102 291.3

(51) Int. Cl.
*F21S 41/143* (2018.01)
*F21S 41/32* (2018.01)
(Continued)

(52) U.S. Cl.
CPC ..... *F21S 41/143* (2018.01); *F21S 41/255* (2018.01); *F21S 41/323* (2018.01); *F21W 2102/13* (2018.01); *F21W 2102/19* (2018.01)

(58) Field of Classification Search
CPC ..... F21S 41/143; F21S 41/141; F21S 41/255; F21S 41/663; F21W 2102/19
See application file for complete search history.

(56) References Cited

U.S. PATENT DOCUMENTS 7,540,638 B2 6/2009 Dassanayake et al.
8,646,956 B2 * 2/2014 Hering ..... B60Q 1/28 362/543

FOREIGN PATENT DOCUMENTS

DE 10057398 A1 5/2002
DE 10110132 A1 1/2003
(Continued)

OTHER PUBLICATIONS

International Search Report dated Apr. 12, 2021 in corresponding application PCT/EP2021/051271.

*Primary Examiner* — Robert J May
(74) *Attorney, Agent, or Firm* — Muncy, Geissler, Olds & Lowe, P.C.

(57) ABSTRACT

A lighting device for vehicles having a first light source, a second light source and a light-shaping apparatus allocated to the first light source and the second light source, wherein the second light source is offset in relation to the first light source, at least in a direction running perpendicularly to the optical axis of the light-shaping apparatus. The light that is incident on the light-shaping apparatus from the first light source is deflected to produce a first light function and wherein the light that is incident on the light-shaping apparatus from the second light source is deflected to produce a second light function, wherein the light-directing surface of the light-shaping apparatus has a free-form surface comprising multiple varyingly curved surface elements.

10 Claims, 2 Drawing Sheets

(51) Int. Cl.

| | |
|---|---|
| ***F21S 41/255*** | (2018.01) |
| *F21W 102/13* | (2018.01) |
| *F21W 102/19* | (2018.01) |

(56) References Cited

FOREIGN PATENT DOCUMENTS

| | | | |
|---|---|---|---|
| DE | 102005030932 | A1 | 1/2007 |
| DE | 102007050220 | A1 | 5/2008 |
| DE | 102008025397 | A1 | 12/2009 |
| DE | 102010041114 | A1 | 3/2012 |
| DE | 202014003078 | U1 | 4/2014 |
| EP | 2431657 | A2 | 3/2012 |
| EP | 2523022 | A1 | 11/2012 |
| EP | 3447371 | A1 | 2/2019 |

* cited by examiner

LIGHTING DEVICE FOR VEHICLES HAVING TWO LIGHT SOURCES AND A FREE FORM LIGHT DIRECTING MEMBER FOR EMITTING TWO LIGHT DISTRIBUTIONS

This nonprovisional application is a continuation of International Application No. PCT/EP2021/051271, which was filed on Jan. 21, 2021, and which claims priority to German Patent Application No. 10 2020 102 291.3, which was filed in Germany on Jan. 30, 2020, and which are both herein incorporated by reference.

BACKGROUND OF THE INVENTION

Field of the Invention

The present invention relates to a lighting device for vehicles, comprising a first light source, a second light source and a light-shaping apparatus allocated to the first light source and the second light source, wherein the second light source is offset in relation to the first light source, at least in a direction running perpendicularly to an optical axis of the light-shaping apparatus, wherein: the light that is incident on the light-shaping apparatus from the first light source is deflected to produce a first light function and wherein the light that is incident on the light-shaping apparatus from the second light source is deflected to produce a second light function.

Description of the Background Art

From DE 100 57 398 A1 a lighting device for vehicles is known, which comprises a light source and a light-shaping apparatus designed as a reflector. The light source is designed as an incandescent lamp with a first filament, which is arranged in a focal point of the parabolic reflector to produce a main beam distribution. The second light source is offset from the first light source, such that the light emitted by it is deflected by means of the reflector to a dynamic cornering light distribution.

From EP 3 447 371 A1 a lighting device for vehicles is known, which comprises a first light source and a second light source, to each of which is allocated the same reflector as a light-shaping apparatus. The reflector is segmented, wherein a first part of the reflector segments exclusively deflects the light emitted by the first light source to produce a first light function and wherein a second part of the reflector segments exclusively deflects light of the second light source to produce a second light function. For example, a main beam function and a static cornering light function can be generated. A disadvantage of the known lighting device is that in addition to the segmented arrangement of the reflector, the light-shaping apparatus additionally has a lens for imaging the reflected light, so that the lighting device requires a relatively large overall space. Since the light sources must be arranged on opposite sides to the side of the reflector, not only the overall depth is relatively large, but also the width.

SUMMARY OF THE INVENTION

It is therefore an object of the present invention to provide a lighting device for vehicles in such a way that two light functions can be provided in a simple and effective way in a space-saving manner and with high illuminance.

To achieve the object, the invention is characterized in that the light-directing surface of the light-shaping apparatus has a free-form surface comprising multiple varyingly curved surface elements, such that the light that is incident on the entire area of the free-form surface from the first light source is deflected to produce a main beam distribution as the first light function and such that the light that is incident on the entire area of the free-form surface from the second light source is deflected to produce a dynamic cornering light distribution as the second light function.

According to the invention, a light-shaping apparatus can be allocated to a first light source and a second light source comprising a free-form surface having multiple varyingly curved surface elements. The same varyingly curved surface elements have a light-directing effect on the light emitted by the first light source and the second light source. They are designed in such a way that a light emitted by the first light source is deflected in such a way that, on the one hand, a main beam distribution is generated to produce the first light function, and on the other hand, light emitted by the second light source is deflected to produce a dynamic cornering light distribution as a second light function. The invention hereby uses the varyingly curved surface elements, which are combined to an entire area of the free-form surface and are effective for both the main beam function and the dynamic cornering light function. The special feature of the invention is to shape a certain number of surface elements in such a way that, depending on the switch-on state of the first light source and the second light source, only the main beam distribution and the dynamic cornering light distribution are generated. Other light distributions cannot be generated by means of the light-shaping apparatus.

The light-shaping apparatus is formed by a number of lenses. The first light source and the second light source are arranged within a light-shaping apparatus when said apparatus is projected onto a transverse plane, such that the overall width of the lighting device is determined by the light-shaping apparatus or lenses. The overall depth of the lighting device is relatively small, since the first light source and the second light source are arranged on the same side with respect to the at least one lens.

The light-shaping apparatus may be formed by a reflector. The overall depth can thus be further reduced, since the first light source and the second light source are arranged between the apex and the leg end when the reflector is transversely projected onto an optical axis.

The first light source and the second light source are arranged on a common heat sink, such that the generated heat can be effectively dissipated.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

A lighting device according to the invention is preferably used in the front area of a vehicle to generate two different light functions.

The lighting device comprises a first light source 1 and a second light source 2, which is offset in the vertical and horizontal directions, said light sources being mounted on a common heat sink 3 via a carrier. The first light source 1 and the second light source 2 are each designed as LED light sources. Optical axes A1, A2 of the first light source 1 and the second light source 2 run in parallel and in a horizontal direction. A main beam direction H of the lighting device runs in a horizontal direction.

Figure 1:
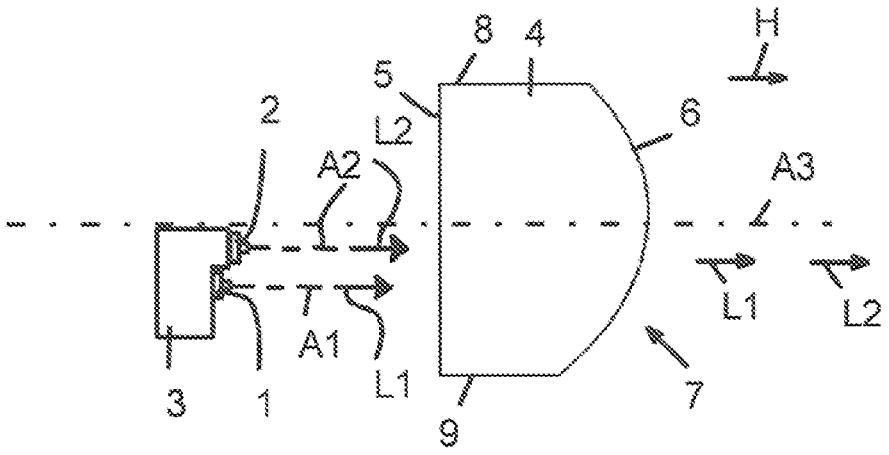
FIG. 1 is a vertical cut through a lighting device according to the invention.
Figure 2:
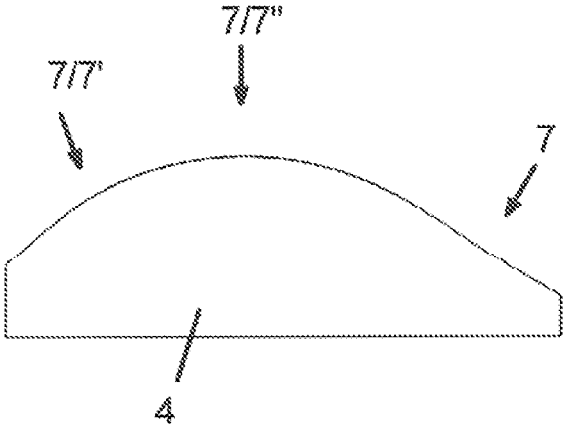
FIG. 2 is a horizontal cut through a lens designed as a light-shaping apparatus.
Figure 3:
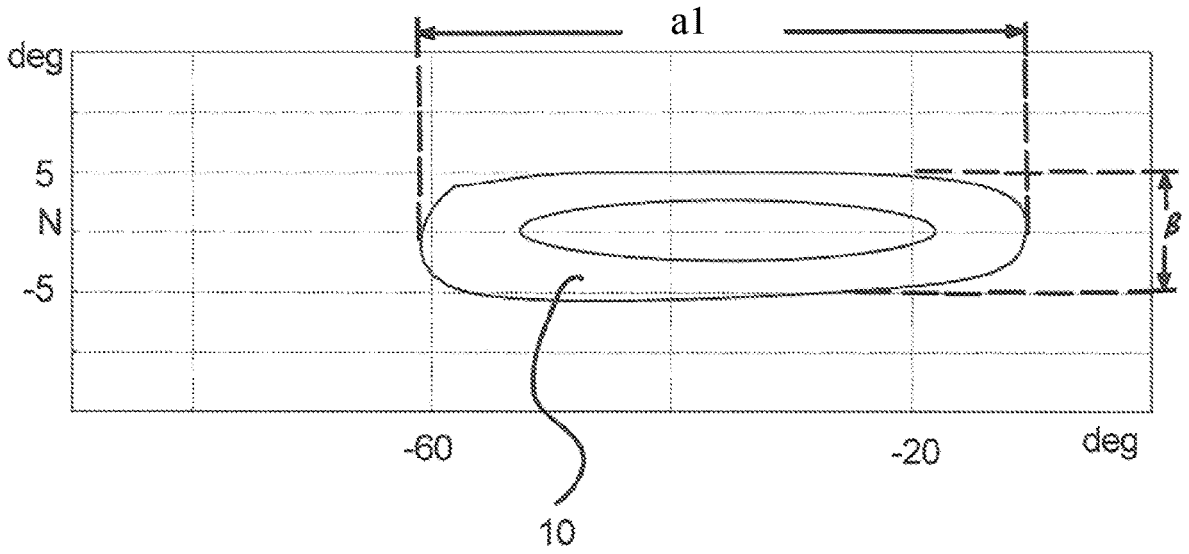
FIG. 3 is a light distribution of a first light function.

A common light-shaping apparatus, which is formed as a single lens 4, is allocated to the first light source 1 and the second light source 2. The lens 4 has a flat light entry surface 5, which runs perpendicularly to the main radiation direction H. The light entry surface 5 of the lens 4 is arranged on a rear side that faces the first light source 1 and the second light source 2. On a front side facing away from the first and second light sources 1, 2, the lens 4 has a free-form surface 6 with multiple curved surface elements 7. The curved surface elements 7 have a varying arc shape or radius. As can be seen from FIG. 2, a curved surface element 7' has a smaller radius or curve than a second curved surface section 7".

In projection on a plane perpendicular to the main beam direction H, the first light source 1 and the second light source 2 are arranged between opposite edges 8, 9 of the lens 4. The overall space width is thus determined by the transverse dimensioning of the lens 4. The free-form surface 6 forms an entire area of the light exit side of the lens 4 and is formed by the plurality of varyingly curved surface elements 7, 7', 7". The entire area or free-form surface 6 forms a light-directing surface by means of which, on the one hand, light L1 emitted from the first light source 1 is imaged to a first light distribution 10 and light L2 emitted by the second light source 2 is imaged to a second light distribution 11, namely a dynamic cornering light distribution.

The first light distribution 10 forms a first light function in which the light L1 is scattered accordingly in a horizontal direction in a scattering angle range $\alpha 1$ of 30° to 40° and in a vertical direction in a scattering angle range $\beta$ of 8° to 15°. The first light distribution 10 extends in an equal vertical scattering angle above and below the horizontal zero line N.

Figure 4:
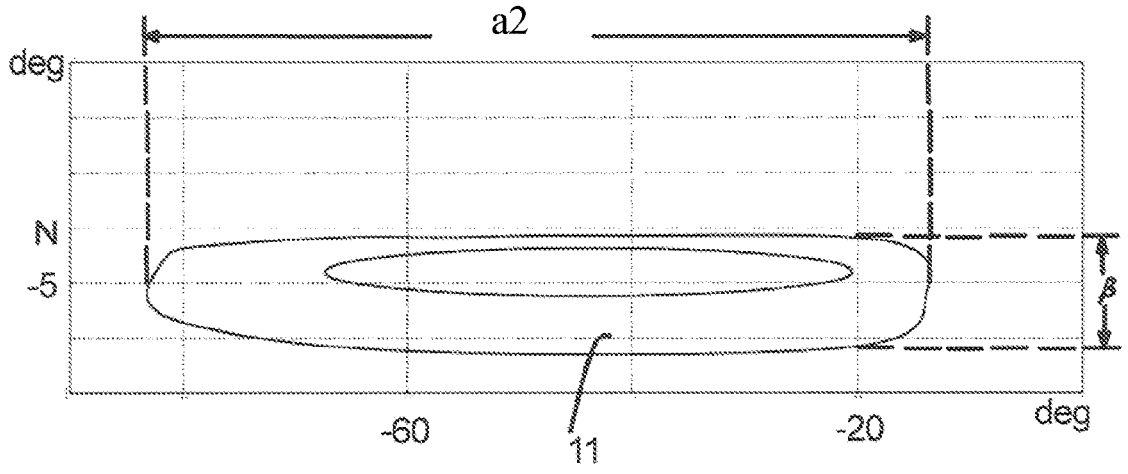
FIG. 4 is a light distribution of a second light function.

The second light distribution 11 (dynamic cornering light distribution) forms a second light function, which has a larger horizontal scattering angle range $\alpha 2$ than the horizontal scattering angle range $\alpha 1$ of the first light distribution 10. The vertical scattering angle range $\beta$ of the second light distribution 11 substantially corresponds to the vertical scattering angle range of the first light distribution 10. The horizontal scattering angle range $\alpha 2$ is 60° to 80°. In the present embodiment according to FIG. 4, the horizontal scattering angle range $\alpha 2$ runs from −20° to −80°, so that a static cornering light is formed on the left side of the vehicle. When the lighting device is arranged mirror-inverted, a static cornering light can be generated on the right side of the vehicle.

According to the invention, the first light source 1 is arranged in the main radiation direction H behind the second light source 2. The second light source 2 is located closer to an optical axis A3 of the lens 4 than the first light source 1.

To generate the main beam 10, only the first light source 1 is switched on. To generate the dynamic cornering light 11, only the second light source 2 is switched on. The first light source 1 and the second light source 2 are preferably designed to be identical.

The light-shaping apparatus may also be formed by a reflector instead of by a number of lenses. The reflector has a free-form surface formed of a plurality of varyingly curved surface elements.

The first light source 1 and the second light source 2 are each arranged outside a focal point of the curved surface elements 7.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lighting device for vehicles comprising:

a first light source;

a second light source; and a light-shaping apparatus allocated to the first light source and the second light source, wherein the second light source is offset in relation to the first light source at least in a direction running substantially perpendicularly to the optical axis of the light-shaping apparatus, wherein the light that is incident on the light-shaping apparatus from the first light source is deflected to produce a first light function, wherein the light that is incident on the light-shaping apparatus from the second light source is deflected to produce a second light function, and wherein a light-directing surface of the light-shaping apparatus has a free-form surface comprising at least two varyingly curved surface elements such that the light that is incident on the entire area of the free-form surface from the first light source is deflected to produce a main beam distribution as a first light function and such that the light that is incident on the entire area of the free-form surface from the second light source is deflected to produce a dynamic cornering light distribution as a second light function.

2. The lighting device according to claim 1, wherein the varyingly curved surface elements of the free-form surface are formed such that the light emitted onto the free-form surface from the second light source and offset to the first light source in the main beam direction is deflected in a horizontal direction in a scattering angle range of 60° to 80° and is deflected in a vertical direction below a horizontal zero line.

3. The lighting device according to claim 1, wherein the varyingly curved surface elements of the free-form surface are formed in such a way that the light that is incident on the free-form surface from the first light source is scattered in the horizontal direction in a scattering angle range of 30° to 40° and in a vertical direction above the horizontal zero line.

4. The lighting device according to claim 1, wherein the varyingly curved surface elements of the free-form surface are formed in such a way that the light that is incident on the free-form surface from the first light source and the second light source is deflected in a vertical direction in a scattering angle range of 8° to 15°.

5. The lighting device according to claim 1, wherein the first light source and the second light source are not arranged in a focal point of the curved surface elements.

6. The lighting device according to claim 1, wherein the light-shaping apparatus is formed by at least two lenses.

7. The lighting device according to claim 1, wherein the light-shaping apparatus is formed by a reflector.

8. The lighting device according to claim 1, wherein the first light source and the second light source have optical axes running substantially in parallel.

9. The lighting device according to claim 1, wherein the first light source and the second light source are each formed as an LED light source.

10. The lighting device according to claim 1, wherein the first light source and the second light source are attached to a common heat sink.

* * * * *